US005220352A

United States Patent [19]

Yamamoto et al.

[11] Patent Number: 5,220,352

[45] Date of Patent: Jun. 15, 1993

[54] THERMAL TRANSFER RECORDING DEVICE

[75] Inventors: Junichi Yamamoto, Hadano; Iwao Fujii, Sagamihara; Yutaka Maeda, Kanagawa, all of Japan

[73] Assignee: Minolta Camera Kabushiki Kaisha, Osaka, Japan

[21] Appl. No.: 784,592

[22] Filed: Oct. 29, 1991

[30] Foreign Application Priority Data

Oct. 29, 1990 [JP] Japan ..... 2-291085

[51] Int. Cl.[5] ..... B41J 2/325

[52] U.S. Cl. ..... 346/76 PH; 346/17; 400/708

[58] Field of Search ..... 346/76 PH, 17; 400/207 E, 237 E, 227.2, 613, 708, 712

[56] References Cited

U.S. PATENT DOCUMENTS

| | | | |
|---|---|---|---|
| 4,690,575 | 9/1987 | Ueda et al. | 400/227.2 |
| 4,879,566 | 11/1989 | Hanabusa | 346/76 PH |
| 4,890,120 | 12/1989 | Sasaki et al. | 346/76 PH |
| 5,064,301 | 11/1991 | Nakamura | 400/207 E |

FOREIGN PATENT DOCUMENTS

| | | | |
|---|---|---|---|
| 0049978 | 3/1985 | Japan | 400/207 E |
| 0179267 | 9/1985 | Japan | 400/227.2 |
| 0054975 | 3/1986 | Japan | 400/207 E |
| 61-98567 | 5/1986 | Japan . | |
| 0089374 | 4/1988 | Japan | 400/207 E |
| 2-39949 | 2/1990 | Japan . | |

*Primary Examiner*—Benjamin R. Fuller
*Assistant Examiner*—N. Le
*Attorney, Agent, or Firm*—Price, Gess & Ubell

[57] ABSTRACT

A thermal transfer recording device for recording an image on a recording sheet by means of an ink film. The device has a cassette accommodating recording sheets and a unit accommodating an ink film both of which are loadable into the main body of the device, and further has a first sensor for detecting the type of the cassette and a second sensor for detecting the type of the unit. The device alerts the operator when the type of the unit is judged to be incompatible with the type of the cassette according to the result of detection by the first and second sensors.

16 Claims, 8 Drawing Sheets

THERMAL TRANSFER RECORDING DEVICE

BACKGROUND OF THE INVENTION

1. Field of the Invention

The present invention relates to a thermal transfer recording device which transfers an image on a recording sheet using an ink film coated with sublimation ink or the like.

2. Description of the Related Arts

In conventional thermal transfer recording devices, thermal heads press through an ink film so as to make pressure contact with a recording sheet disposed against a platen roller, thereby reproducing an image on the recording sheet. Particularly when reproducing a color image on a recording sheet, an ink film coated with three ink colors of, for example, yellow, magenta and cyan is used to print the image on the recording sheet by sequential overlays of the image in the different colors. The aforesaid type of thermal transfer recording device is said to use a return printing method or planar sequence method wherein a monocolor image is printed first, followed by the recording sheet being transported back to the original position for the printing of an image in a second color. Three color printing is accomplished by substantially the same process.

The previously described type of recording device can reproduce color images on various kinds of recording sheets made of dissimilar materials such as a plain paper, transparency sheet for overhead projectors (OHP) and the like. However, in the following description an ink film is used.

The optimum energy applied to the thermal head is standardly set for plain paper. The aforesaid optimum energy induces a reduction in the print quality level relative t print density and the like when reproducing color images on OHP sheets using the same ink film.

Thermal recording devices have been proposed which have various functions for discriminating the different types of recording sheets and which apply an energy on the thermal heads that corresponds to the discriminated type of recording sheet in order to prevent the previously described reduction in the level of print quality.

However, even if the aforesaid applied energy is changed when reproducing a color image using the same ink film, there are limits to the degree to which deterioration of print level quality can be prevented.

In recent years, ink films have been proposed which are coated or the like with inks optimally suited for paper quality recording sheets. Accordingly, the level of print quality can be improved to produce superior color images by loading in the thermal recording device an ink film compatible with the type of recording sheet to be used.

Preventable reduction in print quality in the previously described instance is achievable when the type of recording sheet and the type of ink film are compatible, but is not preventable when the recording sheet and the ink film types are not compatible. Thermal transfer recording devices using ink film coated with sublimation ink not only exhibits a deterioration in print quality when images are reproduced using incompatible recording sheets and ink films, but also have the disadvantage of wasting relatively expensive recording medium.

SUMMARY OF THE INVENTION

A main object of the present invention is to provide a thermal transfer recording device capable of high quality printing regardless of the type of recording sheet to be used.

A further object of the invention is to provide a thermal transfer recording device which can be loaded in the main unit of the apparatus without erroneously mixing the recording sheets and an incompatible ink film.

A still further object of the invention is to provide a thermal transfer recording device capable of high quality printing by supplying uniformly constant applied energy to the thermal head(s) regardless of the type of recording sheet to be used.

These objects of the present invention are accomplished by providing a thermal transfer recording device comprising:

a cassette loadable into the main body of the device for accommodating either first recording sheets or second recording sheets having different characteristics than the first recording sheets;

a unit loadable into the main body of the device for accommodating either a first ink film compatible with the first recording sheets or a second ink film compatible with the second recording sheets;

first detecting means for detecting the type of the cassette loaded in the main body of the device;

second detecting means for detecting the type of the unit loaded in the main body of the device;

alarm means for alerting the operator; and control means for controlling the alarm means so as to be actuated when the type of the unit is incompatible with the type of the cassette.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
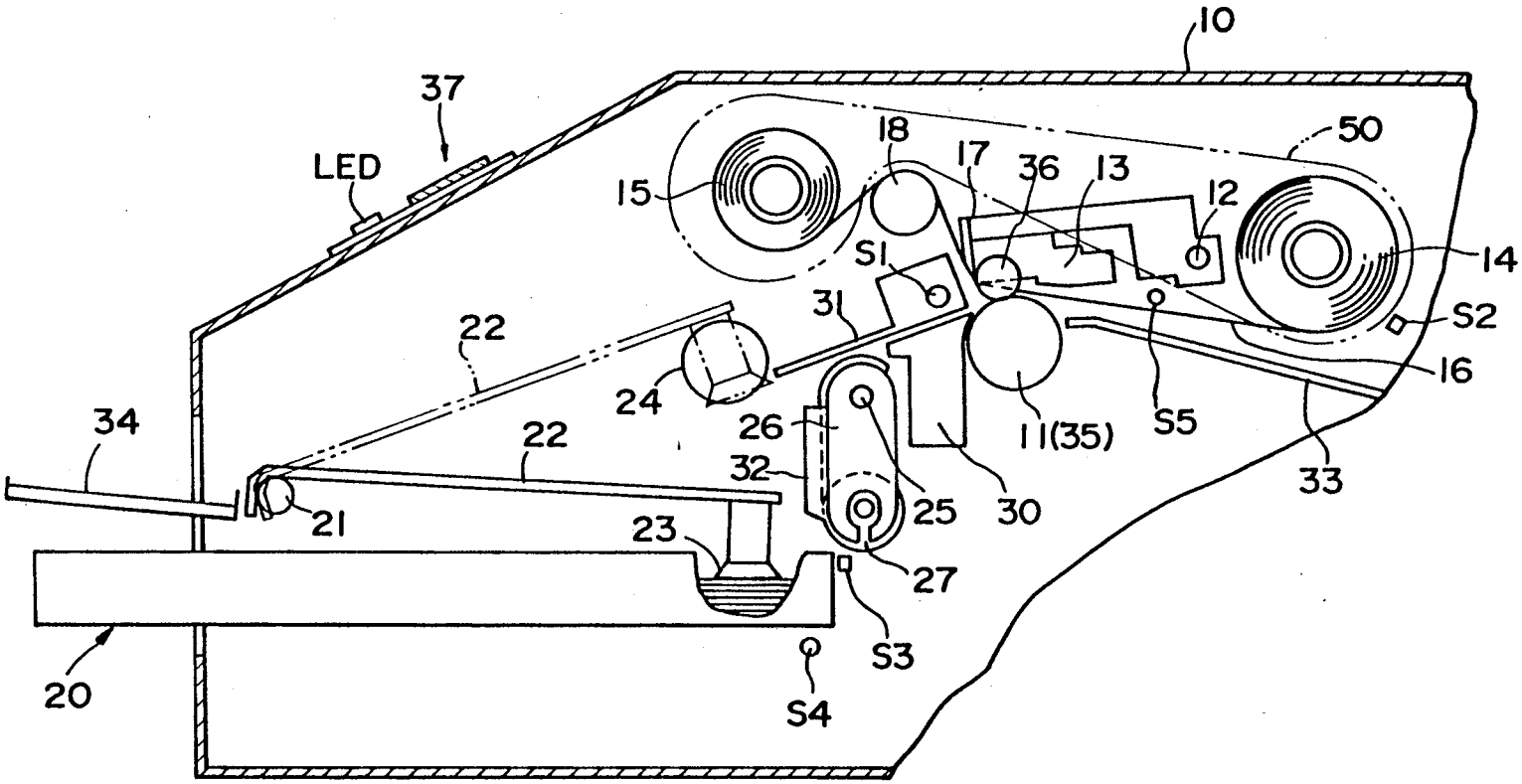
FIG. 1 is a lateral section view showing the essential portions of a first embodiment of the thermal transfer recording device of the present invention.

FIG. 1 is a lateral section view showing the essential portion of a first embodiment of the thermal transfer recording device of the invention. A platen roller 11 is installed within the device casing 10 so as to be rotatable by a platen motor M1 not shown in the drawing. Also provided in the casing 10 confronting the platen roller 11 is a thermal head 13 which is oscillatable about a support shaft 12 and can be pressed against and retracted from the platen roller 11. The strip-like ink film 16 is fed from the feed film roll 14, passes between the thermal head 13 and the platen roll 11, and is transported to the receiving film roll 15 so as to be wound thereupon. The aforesaid rolls 14 and 15 are housed within the ink film cassette 50 indicated by the imaginary line in the drawing. This ink film cassette 50 is detachable from the casing 10. A sensor S2 of the contact type such as a limit switch or the like for detecting the presence of the ink cassette is mounted on the casing 10 and actuated by direct contact with a part of the cassette 50 so as to detect the cassette 50 when loaded in the predetermined position in the casing 10. The ink film 16 is guided by the separating member 17 disposed at the leading end of the thermal head 13 and the film winding roller 18 and is wound upon the receiving film roll 15 via the actuation of the receiving film roll 15.

A paper cassette 20 is detachably loaded in the casing 10 and accommodates a stack of recording paper sheets P. A sensor S3 of the contact type such as a limit switch or the like for detecting the presence of the paper cassette is mounted on the casing 10 and actuated by direct contact with a part of the cassette 20 so as to detect the cassette 20 when loaded in the predetermined position in the casing 10.

A feed plate 22 is oscillatably mounted on a support shaft 21 to feed the recording sheets P accommodated in the cassette 20 one sheet at a time, and a vacuum cup 23 is provided at the other free end, i.e., the leading end, of the plate 22 to vacuum suction the recording sheets P. The feed plate 22 rotatingly swings in the clockwise direction in FIG. 1 and a single recording sheet P is suctioned by the vacuum cup 23 so that, thereafter, when the feed plate 22 returns to the original position indicated by the dashed line in the drawing, the leading end of the recording sheet P is lifted to a predetermined position. An auxiliary roller 24 is rotatably mounted at the aforesaid lifted position; the recording sheet P is gripped by the tip of the armature 26 oscillatingly mounted on the support shaft 25 and the aforesaid auxiliary roller 24 so as to be transported via the rotation of the rotatably mounted roller 27. The roller 27 is driven by a transport motor M2 (not illustrated) connected thereto via gears or the like. Further, the armature 26 is driven by an oscillating means not shown in the drawing.

Accordingly, the leading end of the recording sheet P which has been lifted by the vacuum cup 23 is gripped by the auxiliary roller 24 and the roller 27 via the rotation of the armature 26 in the clockwise direction, and is advanced toward the right in the drawing. A lower guide member 30 is provided between the platen roller 11 and the shaft 25 and an upper guide member 31 is disposed thereabove to guide the transport of the sheet P. A guide panel 32 is also fixedly attached to the armature 26.

Printing an image on the recording sheet P is accomplished after the recording sheet P has been transported to the advance end position and is being transported on return. A guide panel 33 is provided o the right side of the platen roller 11 to guide the recording sheet P while it is being transported to the advance end position after the sheet P passes the platen roller 11. When printing as previously described, the recording sheet P is returned and a sheet detecting sensor S1 such as a photosensor is provided on the upper guide panel 31 in order to detect the leading end position of the sheet P. A discharge tray 34 is mounted above the paper cassette 20 to accommodate the recording sheets P after the image formation is completed. Whenever the sheet P is discharged toward the aforesaid discharge tray 34, the feed panel 22 is rotated clockwise from the origin position described by the dashed line in FIG. 1 to a predetermined position so as to guide the recording sheet P on the top surface of the feed panel 22.

The length of the platen roller 11 is set so as to be substantially the same as the width of the ink film 16. Both ends of the platen roller 11 have sheet gripping rollers 35 fixedly attached thereto. The sheet gripping rollers 35 are made of a material having a high degree of hardness, the exterior surfaces of which have a high friction coefficient, and the major diameters of which are identical to the diameter of the platen roller 11. Sheet pressing rollers 36 are positioned opposite the aforesaid sheet gripping rollers 35 to hold both right and left sides of the recording sheet therebetween. These sheet pressing rollers 36 are rotatably mounted on armatures not shown in the drawing, and are movable so as to be pressed against and retracted from the sheet gripping rollers 35 via the oscillation of the aforesaid armatures. The recording sheet P has a widthwise dimension greater than the width of the ink film 16 and is therefore gripped on both sides between the sheet gripping rollers 35 and the pressing rollers 36 from the start of printing until printing is completed. The speeds at which the recording sheet P is advanced and returned are standardized relative to the rotational speeds of the rollers 35 and 36.

The paper cassette 20 is described hereinafter with reference to FIGS. 2A and 2B.

Figure 2A:
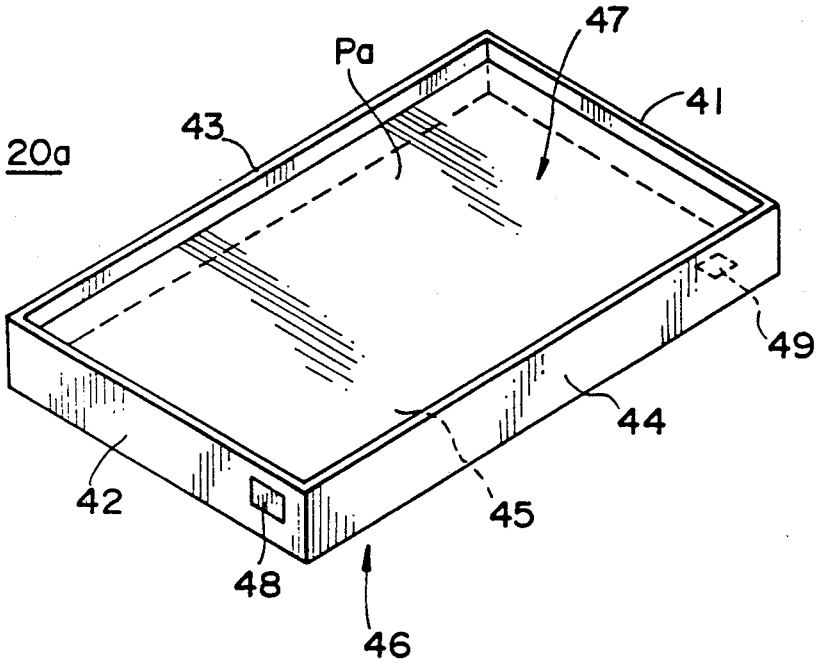
FIGS. 2A and 2B are perspective views of the paper cassettes.
Figure 2B:
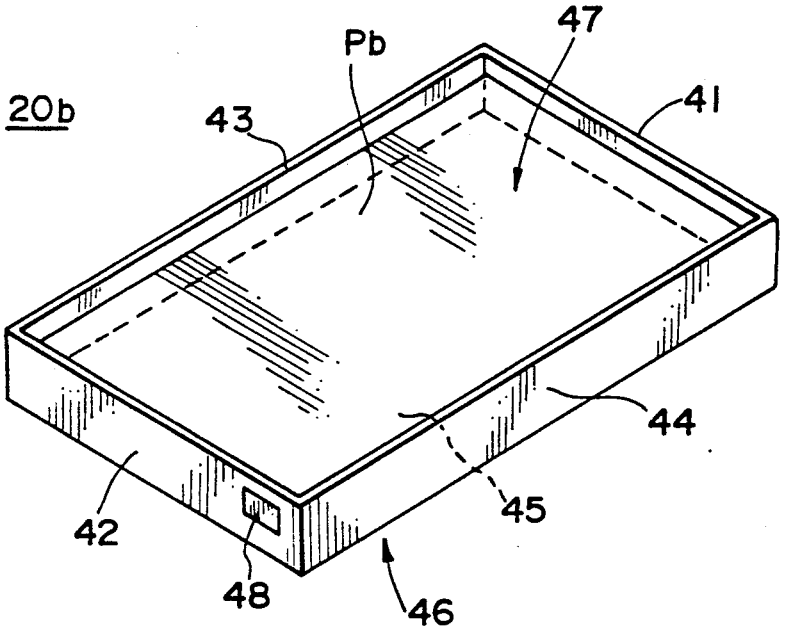

The present embodiment provides two types of paper cassettes, the OHP cassette **20*a* for accommodating sheets pa for use in transparency type overhead projectors (OHP) as shown in FIG. 2A, and the cassette 20*b* for accommodating plain synthetic sheets Pb as shown in FIG. 2B, wherein one of the the cassettes 20*a* or 20*b* is loaded in the casing 10. When either of the cassettes 20*a* or 20*b* is loaded in the casing 10, the rectangularly shaped cassette body 46 comprises an interior wall 41 positioned inside the casing 10, an exterior wall 42 positioned outside the casing 10, the side walls 43 and 44, and a base 45, so as to form an accommodating portion 47 within the cassette body 46 for accommodating either the OHP sheets Pa or the plain synthetic sheets Pb. The type of sheets accommodating in the cassettes 20*a* and 20*b* may be indicated by the operator by labels 48 applied to the exterior wall 42**.

A recording sheet marker 49 is provided on the exterior surface of the base 45 of the OHP cassette **20*a*, as shown in FIG. 2A, whereas a recording sheet marker 49 is not provided on the synthetic sheet cassette 20*b*. A recording mark detecting sensor S4 such as a photosensor is attached to the casing 10, as shown in FIG. 1, to detect the presence of the previously described recording mark 49 when the cassette 20 has been loaded in the casing 10. The recording mark discriminating means comprises aforesaid sensor S4**.

Figure 3A:
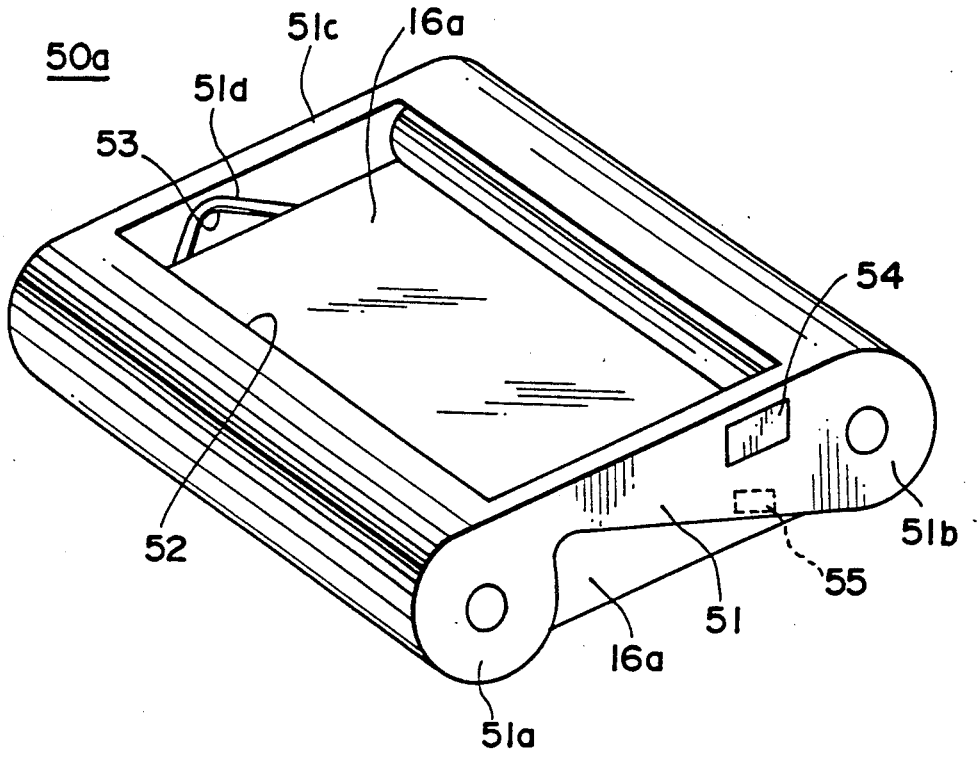
FIGS. 3A and 3B are perspective views of the ink film cassettes.
Figure 3B:
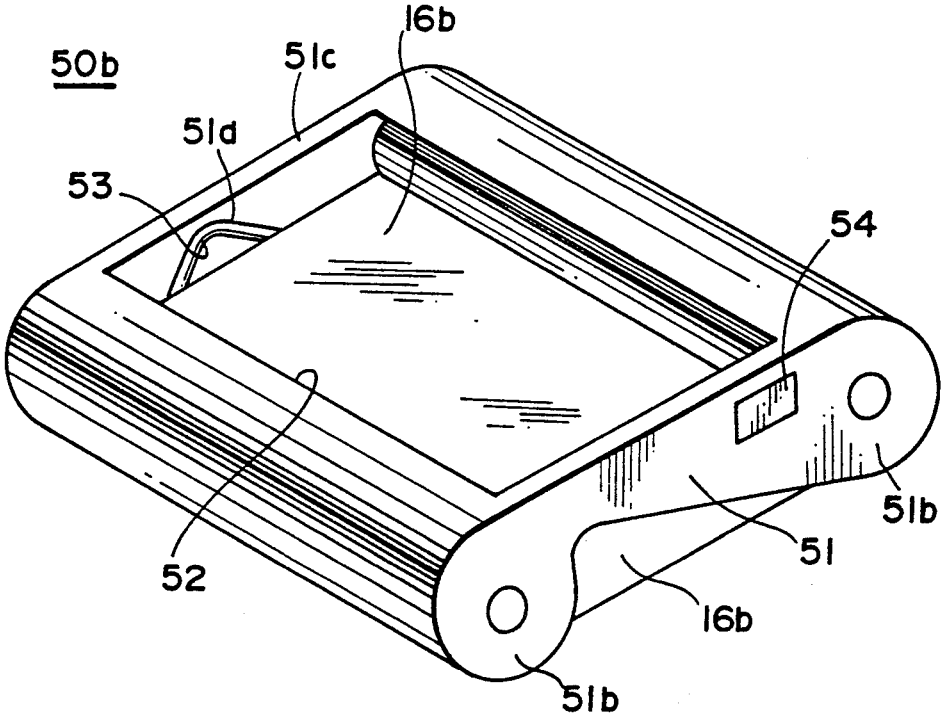

FIGS. 3A and 3B are illustrations showing the ink film cassette 50. The present embodiment provides two types of cassettes 50. FIG. 3A shows the OHP ink film cassette 50*a* for accommodating an OHP ink film 16*a* compatible with the paper quality of OHP sheets Pa, and FIG. 3B shows the synthetic sheet ink film cassette 50*b* for accommodating a synthetic ink film 16*b* compatible with the paper quality of synthetic sheets Pb. Since the thermal transfer recording device shown in FIG. 1 forms color images on recording sheets P, the ink films 16*a* and 16*b* have a base layer upon which are provided layers of ink in the colors yellow, magenta, cyan and possibly black that are somewhat longer in length than the recording sheets Pa and Pb. The ink film cassettes 50*a* and 50*b*, as shown in FIGS. 3A and 3B, have a cylindrical receiving roll accommodating portion 51*a* formed at one end of the cassette body 51, and a cylindrical feed roll accommodating portion 51*b* formed at the other end thereof. An opening 52 is formed at the top of the side panels 51*c* of the cassette body 51, and an opening 53 is formed at the bottom of the side panels 51*d* thereof. Either one of the thus formed ink film cassettes 50*a* and 50*b* can be loaded in the casing 10, as shown in FIG. 1. The type of ink film 16 accommodated in each ink film cassette 50*a* and 50*b* may be indicated by the operator via labels 54 applied to the cassette bodies 51.

An ink film marker 55 is provided on the exterior surface of the bottom side panel 51*d* of the OHP ink film cassette 50*a*, as shown in FIG. 3A, whereas an ink film marker 55 is not provided on the synthetic sheet ink film cassette 51*b*. An ink film mark detecting sensor S5 such as a photosensor is mounted on the casing 10, as shown in FIG. 1, to detect the presence of the aforesaid ink film mark 55 when the ink film cassette 50 is loaded in the casing 10. The ink film discriminating means comprises the aforesaid sensor S5.

An operation panel 37 is provided on the top inclined surface of the casing 10. The operation panel 37 has an arrangement of various operation switches, a panel for displaying operator instructions for the operator, alarm lamps LEDs that are lighted whenever the type of recording sheet P and the type of ink film 16 are incompatible, and the like.

Figure 4:
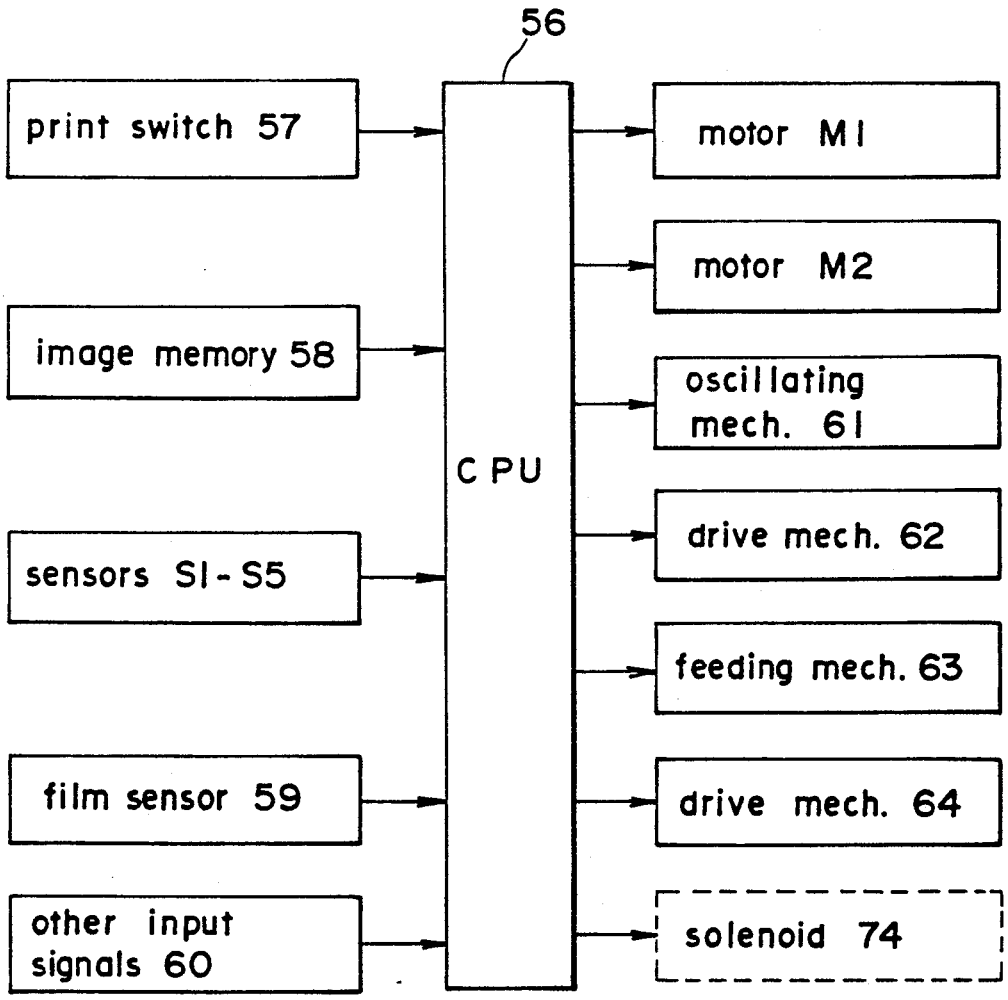
FIG. 4 is a block diagram wherein the solid lines indicate the control portion of the first embodiment of the thermal transfer recording device of the present invention, and both the solid and broken lines indicate the control portion of the second embodiment of the thermal transfer recording device of the present invention.

FIG. 4 is a block diagram wherein the region delineated by the solid lines describes the control portion of the aforesaid thermal transfer recording device. The central processing unit (CPU) 56 receives input signals from the print switch 57 for issuing the start printing command, image memory 58 for storing the image data to be reproduced, sheet detecting sensor S1, paper cassette detecting sensor S3, recording sheet mark detecting sensor S4, ink film mark detecting sensor S5, film sensor 59 for detecting the marks provided on the ink film 16 to mark the positions of each color region of the ink film 16, as well as other input signals. The CPU 56 outputs control signals to the platen motor M1 for drivingly rotating the platen roller 11 in both the forward and reverse directions, and the transport motor M2 for driving the roller 27 in both the forward and reverse directions. The CPU 56 further outputs control signals to the head oscillating mechanism 61 comprising, for example, a cam mechanism or the like for oscillating the thermal head 13, head drive mechanism 62 for transmitting image data to the thermal head 13, sheet feeding mechanism 63 for driving the arm 26 and the feed plate 22, film drive mechanism 64 to drive the receiving film roll 15 so as to transport the ink film 16, and the like.

The energy supplied to the thermal head 13 in the present embodiment is changed in accordance with the combinations of the recording sheets P and the ink films 16. The internal read only memory (ROM) in the CPU 56 contains therein the predetermined data for the optimum applied energy when the type of recording sheet P and the type of ink film 16 are compatible, optimum applied energy when the OHP sheets Pa and the synthetic sheet ink film 16*b* are used in combination, and optimum applied energy when the synthetic sheet Pb and the OHP sheet ink film 16*a* are used in combination.

Figure 5:
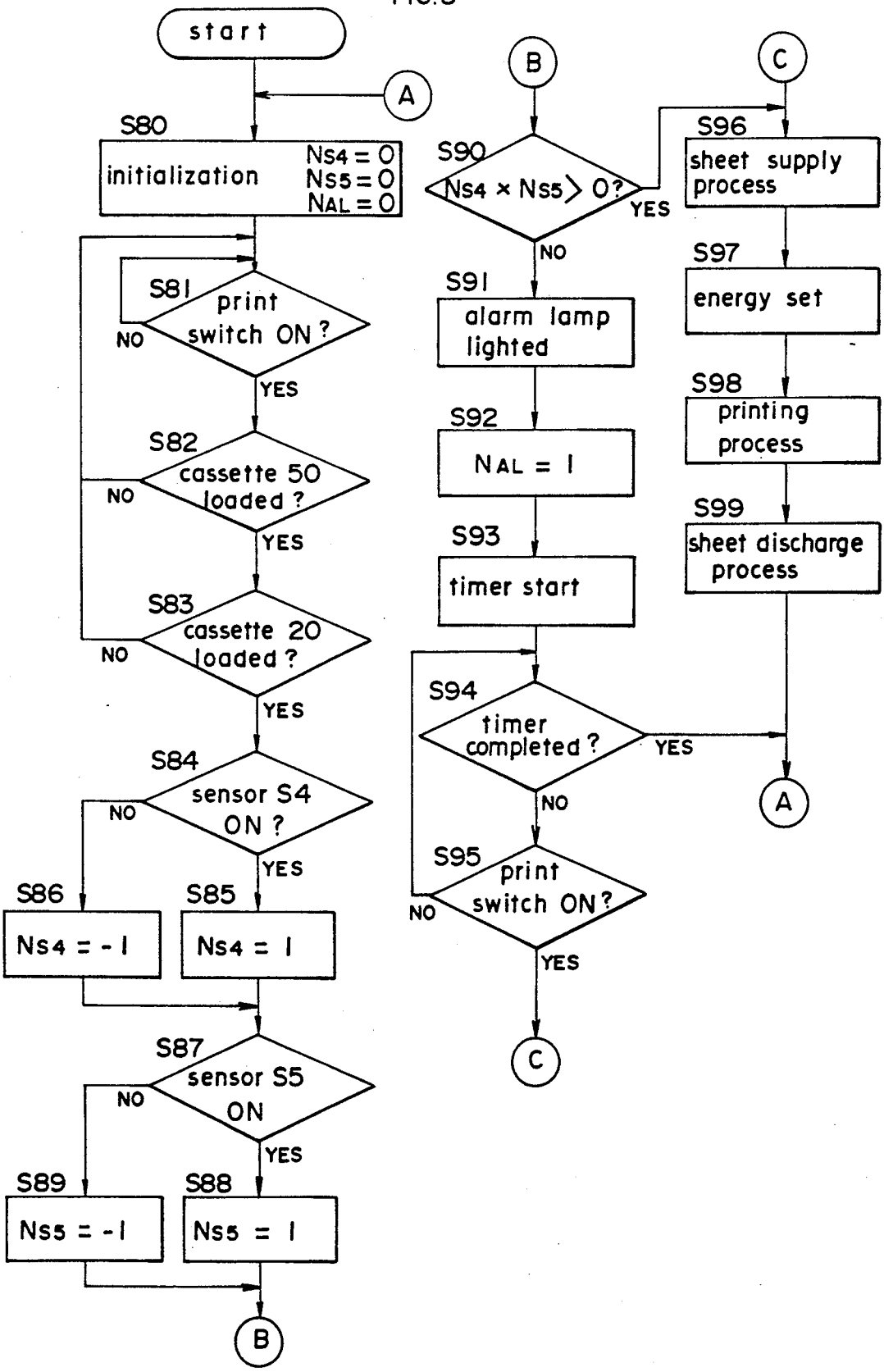
FIG. 5 is a flow chart showing the operating sequence of the first embodiment of the thermal transfer recording device of the invention.

The image forming sequence of the thermal transfer recording device is described hereinafter with reference to FIG. 5.

When the power unit of the thermal transfer recording device in the drawing is switched on, the CPU 56 and each component of the device is initialized in step 80. Initialization sets variable $N_{S4}$ at a predetermined value [1 or −1] based on the output signal of the recording sheet detecting sensor S4, a variable $N_{S5}$ is set at a predetermined value [1 or −1] based on the output signal of the ink film mark detecting sensor S5, and a variable $N_{AL}$ is set at a predetermined value [1] when the type of recording sheet P and the type of ink film 16 are incompatible. At this time, the thermal head 13 is separated from the platen roller 11, and the sheet pressing roller 36 makes pressure contact with the sheet gripping roller 35. The feed panel 22 is rotated to the position indicated by the imaginary line in FIG. 1, and the armature 26 is set to position the roller 27 at the position shown in FIG. 1.

In FIG. 1, the advance transport sends the recording sheet P to the right in the drawing, and the return transport sends the sheet P in the reverse direction. The sheets P are advance transported by the forward rotation of the motors M1 and M2, and returned in the opposite direction by the reverse rotation of the of motors M1 and M2.

In order to form an image on a recording sheet P, the operator switches on the print switch 57 and the status of the switch 57 is detected in step 81. Then, in step 82, a check is made to determine whether or not the ink film cassette 50 is loaded in the casing 10 via the sensor S2. If the ink film cassette 50 is not detected, the routine returns to step 81 and the film cassette load 50 indicator is displayed on the operation panel 37. If the film cassette 50 is detected, a check is made in step 83 to determine whether or not the paper cassette 20 is loaded in the predetermine position in the casing 10 via the sensor S3. If the paper cassette 20 is not detected, the routine returns to step 81 and the paper cassette 20 load indicator is displayed on the operation panel 37.

If the paper cassette 20 is detected, a check is made for the presence of the sheet mark 49 on the cassette 20 via the sheet mark detecting sensor S4 in step 84. When the sheet mark 49 is detected the cassette 20 is the OHP sheet cassette 20*a*, meaning the cassette 20 accommodates OHP sheets Pa as the recording sheets P. Therefore, the variable $N_{S4}$ is set at the predetermined value [1] in step 85. If the sheet mark 49 is not detected, on the other hand, the cassette 20 is the synthetic sheet cassette 20*b*, meaning the cassette 20 accommodates synthetic sheets Pb as the recording sheets P. Therefore, the variable $N_{S4}$ is set at a predetermined value [−1] in step 86.

Then, in step 87, the presence or absence of the ink film mark 55 of the film cassette 50 is detected via the film mark detecting sensor S5. If the film mark 55 is detected, the film cassette 50 is the OHP film cassette 50*a*, meaning the cassette 50 accommodates OHP ink film 16*a*. Therefore, the variable $N_{S5}$ is set at a predetermined value [1] in step 88. If the film mark 55 is not detected, on the other hand, the film cassette 50 is the synthetic sheet film cassette 50*b*, meaning the cassette 50 accommodates synthetic sheet ink film 16*b*. Therefore, the variable $N_{S5}$ is set at a predetermined value [−1] in step 89.

When the setting of the variable NS5 at the predetermined value has been completed, a check is made in step 90 to determine whether or not the type of recording sheet P and the type of ink film 16 are compatible. That is, the variables $N_{S4}$ and $N_{S5}$ are calculated and if their product is positive the type of recording sheet P and the type of ink film 16 are judged compatible, whereas if the product is negative the type of recording sheet P and the type of ink film 16 are judged incompatible.

When the type of recording sheet P and the type of ink film 16 are judged compatible via the results of the aforesaid discrimination, the process continues to step 96 to start reproduction the image on the sheet P. When the sheet type and film type are found to be incompatible, however, an alarm lamp LED is lighted in step 91 to alert the operator that the sheet P type and the film 16 types are incompatible. Then, in step 92 the variable $N_{AL}$ is set at a predetermined value [1].

When the type of recording sheet P and the type of ink film 16 are incompatible, the process may be controllably returned to the initialization state of step 80. However, there may be times when it is desirable to change the type of recording sheet P or ink film 16 from the balanced relationship of the residual quantities of the recording sheet P or the ink film 16 even when the operator determines the type of recording sheet P and the type of ink film 16 are incompatible. In the present embodiment, therefore, when the type of recording sheet P and the type of ink film 16 are not compatible and the operator recognizes the incompatibility but if printing is still desired, a timer is started in step 93 and until the time of the timer has elapsed in step 94, the operator again switches on the print switch 57 in step 95 and the process for reproducing the image on the recording sheet P is started in step 96. On the other hand, when the time of the aforesaid timer has elapsed in step 94, the operator corrects the loaded paper cassette 20 or ink film cassette 50 and the process returns to the initialization state of step 80.

The sheet supplying process is executed in step 96. First, the sheet pressing roller 36 is separated from the sheet gripping roller 35, then, when the feed panel 22 is oscillated a recording sheet P is fed from within the sheet cassette 20 via the vacuum suction of the suction cup 23, and thereafter the armature 26 is rotated so that the roller 27 makes pressure contact with the auxiliary roller 24. In this state, the motor M2 is forward rotated to rotate the roller 27 in the clockwise direction and advance the recording sheet P. After the sheet detecting sensor S1 changes from the off state to the on state and a predetermined time interval has elapsed, the transport motor M2 stops rotation. Then, a cam mechanism not shown in the drawing is actuated to press the thermal head 13 against the platen roller 11, whereupon the pressing roller 36 makes pressure contact with the sheet gripping roller 35, the armature 26 returns to the origin position and the roller 27 is separated from the auxiliary roller 24. The feed panel 22 is also oscillated so as to return to the position described by the solid line in FIG. 1. The pressure contact of the thermal head 13 is released and the platen motor M1 is forward rotated to advance the recording sheet P via the sheet pressing rollers 36 and the sheet gripping rollers 35. When the sheet detecting sensor S1 is switched off, the detection of the trailing end of the sheet P by the sensor S1 is indicated, i.e., the platen motor M1 is stopped and the thermal head 13 makes pressure contact. In this state, the sheet supplying process is completed.

When the sheet supplying process is completed, the energy applied to the thermal head 13 is set in accordance with the values of the variables $N_{AL}$ and $N_{S4}$ in step 97. That is, the value of the variable $N_{AL}$ is determined and if that value is [0], the type of recording sheet P and the type of ink film 16 are compatible, and the applied energy has been previously stored in the ROM and is therefore read therefrom. If the value of the variable $N_{AL}$ is [1], i.e., the value of variable $N_{S4}$ is [1], the OHP sheet Pa and the synthetic sheet ink film 16*b* are being used in combination, and the applied energy previously stored in ROM is read therefrom. If the value of the variable $N_{AL}$ is [1], i.e., the value of the variable $N_{S4}$ is [−1], the synthetic sheet Pb and the OHP ink film 16*a* are being used in combination, and the applied energy previously stored in ROM is read therefrom.

When the energy to be applied to the thermal head 13 has been read from the ROM, the printing process is executed in step 98. The printing process first reversely drives the platen motor M1 to rotate the platen roller 11 in the counterclockwise direction and return transport the recording sheet P. Thus, while the recording sheet P is returned, image signals are transmitted from the image memory 58 to the thermal head 13, and the first color yellow image i sprinted by applying the energy set in step 97 to the thermal head 13. When the printing of the yellow image has been completed, pressure contact between the thermal head 13 and the platen roller 11 is released, and thereafter the platen motor M1 is forward rotated to advance the recording sheet P. when the sheet detecting sensor S1 is switched off by the advance of the sheet P, i.e., when the platen motor M1 is stopped, the thermal head 13 make pressure contact. Then, the printing process is again executed and the second color magenta image is printed and the third color cyan image is printed, thereby completing the printing process.

When the printing process is completed, the armature 26 is oscillated to bring the roller 27 into pressure contact with the auxiliary roller 24 in step 99. Then, the pressure contact of the thermal head 13 is released and the sheet pressing rollers 36 are separated from the sheet gripping rollers 35. The motor M2 is reversely rotated to reversely rotate the roller 27, and when the recording sheet P is discharged toward the discharge tray 34 the motor M2 is stopped. Thus, a color image is reproduced on a single recording sheet P.

In the previously described embodiment, when the type of recording sheet P and the type of ink film 16 are incompatible, the operator is alerted via the lighted warning lamp LED so that the operator is aware that incompatibly mismatched recording sheet P and ink film 16 are erroneously loaded in the thermal transfer recording device. Accordingly, an image cannot be formed on the recording sheet P without the operator being aware of the incompatibility of the sheet and film types, so that a reduction in print quality can be prevented before it occurs. Therefore, the original image quality is assured by reloading the proper type of recording sheet P or ink film 16.

When the type of recording sheet P and the type of ink film 16 are incompatible and the operator, having been alerted to this situation, still executes the printing process, the optimum applied energy for the thermal head is based on the sheet P and ink film 16 combination so that the printing quality can be improved to a level approaching the original tones achieved with compatible types of sheet and ink film. Therefore, recording sheet P and ink film 16 can be used without waste and printing can be accomplished when the sheet and film are incompatible.

In the present embodiment, the print quality can be improved when the recording sheet P and the ink film 16 are incompatible by changing the applied energy to the thermal head 13. However, it should be noted that print quality may also be improved by changing the contact pressure of the thermal head 13 and changing the winding tension of the ink film 16.

Figure 6A:
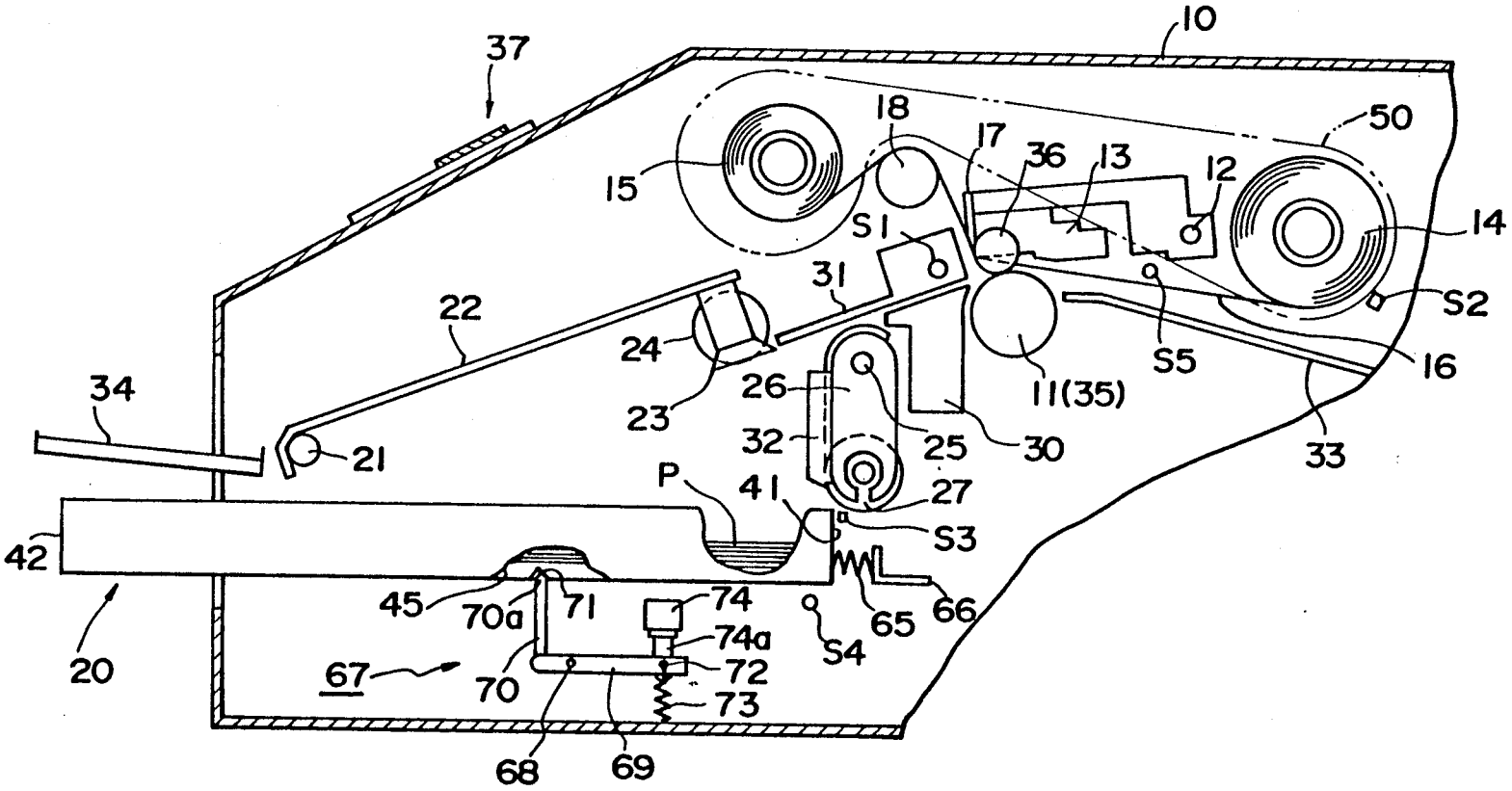
FIGS. 6A and 6B are lateral section views showing the essential portions of the second embodiment of the thermal transfer recording device of the invention.
Figure 6B:
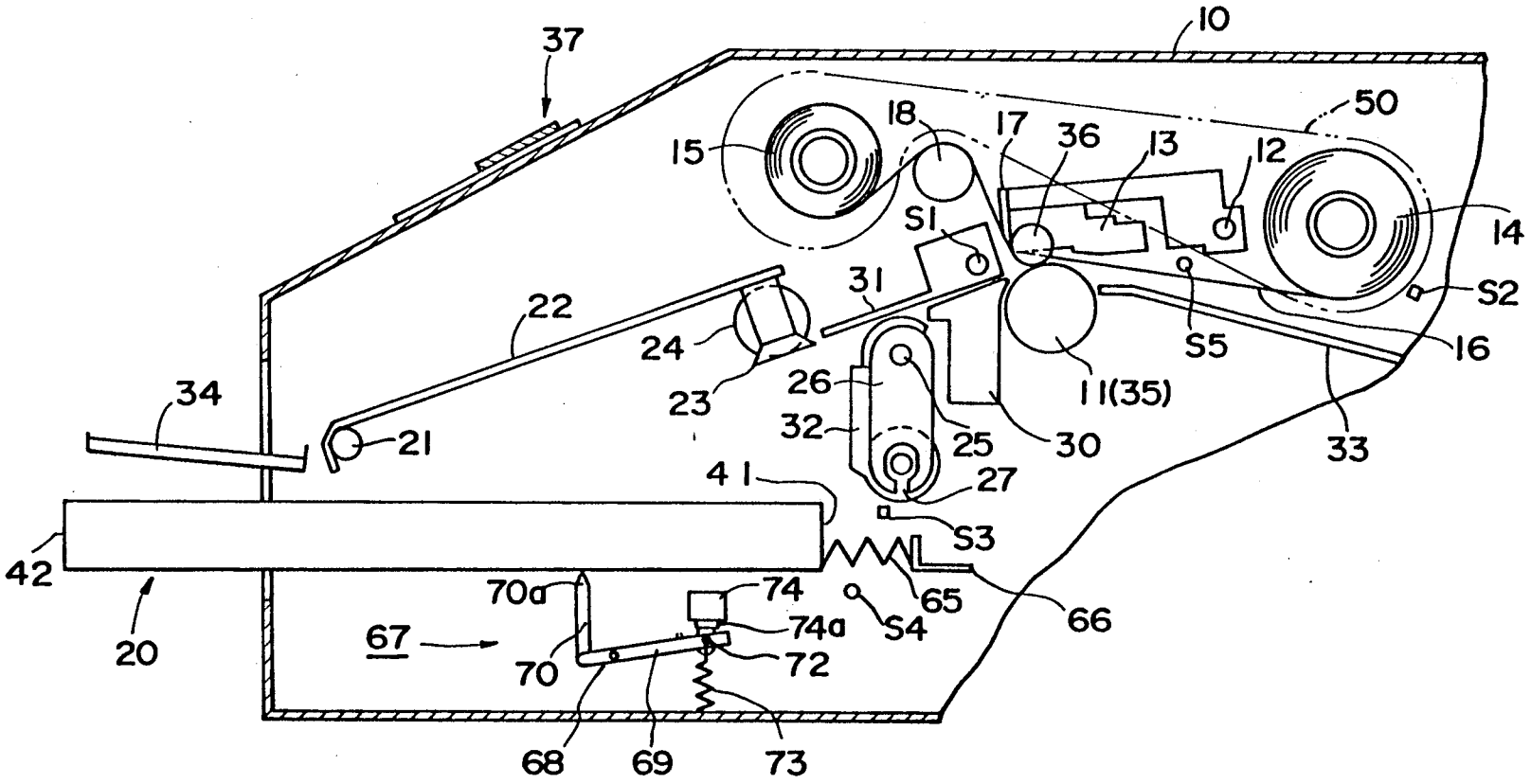

FIGS. 6A and 6B are lateral section views showing the essential portions of a second embodiment of the thermal transfer recording device of the present invention. In the second embodiment, when the type of recording sheet P and the type of ink film 16 are incompatible, the sheet cassette 20 is constructed such that it is somewhat ejected outwardly from the casing 10.

As shown in FIG. 6A, a compression spring 65 is mounted to a spring mount 66 within the casing 10 so as to abut the interior wall 41 of the sheet cassette 20. The aforesaid compression spring 65 exerts a presser bar pressure from the interior wall 41 toward the exterior wall 42 on the cassette 20 loaded in the casing 10. A locking mechanism 67 is provided on the underside of the cassette 20 to hold the cassette 20 within the casing 10 against the aforesaid pressure. The locking mechanism 67 has a support armature 69 oscillatably mounted to the support shaft 68 which is fixedly attached to the casing 10. The first end of the support armature 69 has attached thereto an arm 70 extended toward the base 45 of the cassette 20. The top end of the arm 70 is provided a hook 70*a* linked to a channel 71 formed in the aforesaid base 45. The second end of the support armature 69 is provided with a fixedly attached pin 72, and a compression spring 73 is mounted between the pin 72 and the casing 10. The compression spring 73 exerts an elastic force on the arm 70 in a direction releasing the linkage with the channel 71. The actuator 74*a* of a solenoid 74 is connected to the aforesaid pin 72 to link the hook 70*a* of the arm 70 with the channel 71 against the aforesaid elastic force.

As shown in FIG. 6A, when the solenoid 74 is in the off state and electric current is not supplied thereto, the actuator 74*a* is extended downwardly so that the second end of the support armature 69 is pushed downward against the elastic force exerted by the compression spring 73, and the first end of the armature 69 is moved upwardly. Accordingly, the hook 70*a* of the arm 70 engages with the channel 71, and the sheet cassette 20 is thereby held within the casing 10 against the pressure exerted by the compression spring 65. As shown in FIG. 6B, on the other hand, when the solenoid 74 is in the on state and electric current is supplied thereto, the actuator 74*a* is contracted upwardly so that the second end of the support armature 69 is raised by the elastic force exerted by the compression spring 73, and the first end of the armature 69 is moved downwardly. Therefore, the linkage of the channel 71 and the hook 70*a* of the arm 70 is released, and the sheet cassette 20 held within the casing 10 is pushed out leftwardly in the drawing by the pressure of the compression spring 65.

In the second embodiment of the thermal transfer recording device of the present invention, when the type of recording sheet P and the type of ink film 16 are incompatible, the solenoid is switched on and the cassette 20 is ejected outwardly from the casing 10 as shown in FIG. 6B.

FIG. 4 is a block diagram wherein the solid and dashed lines described the control portion of the thermal transfer recording device of the second embodiment. Control signals are transmitted from the CPU 56 to the aforementioned solenoid 74. In the second embodiment the energy applied to the thermal head 13 cannot be changed. Further, an alarm lamp LED is not provided on the operation panel 37.

Figure 7:
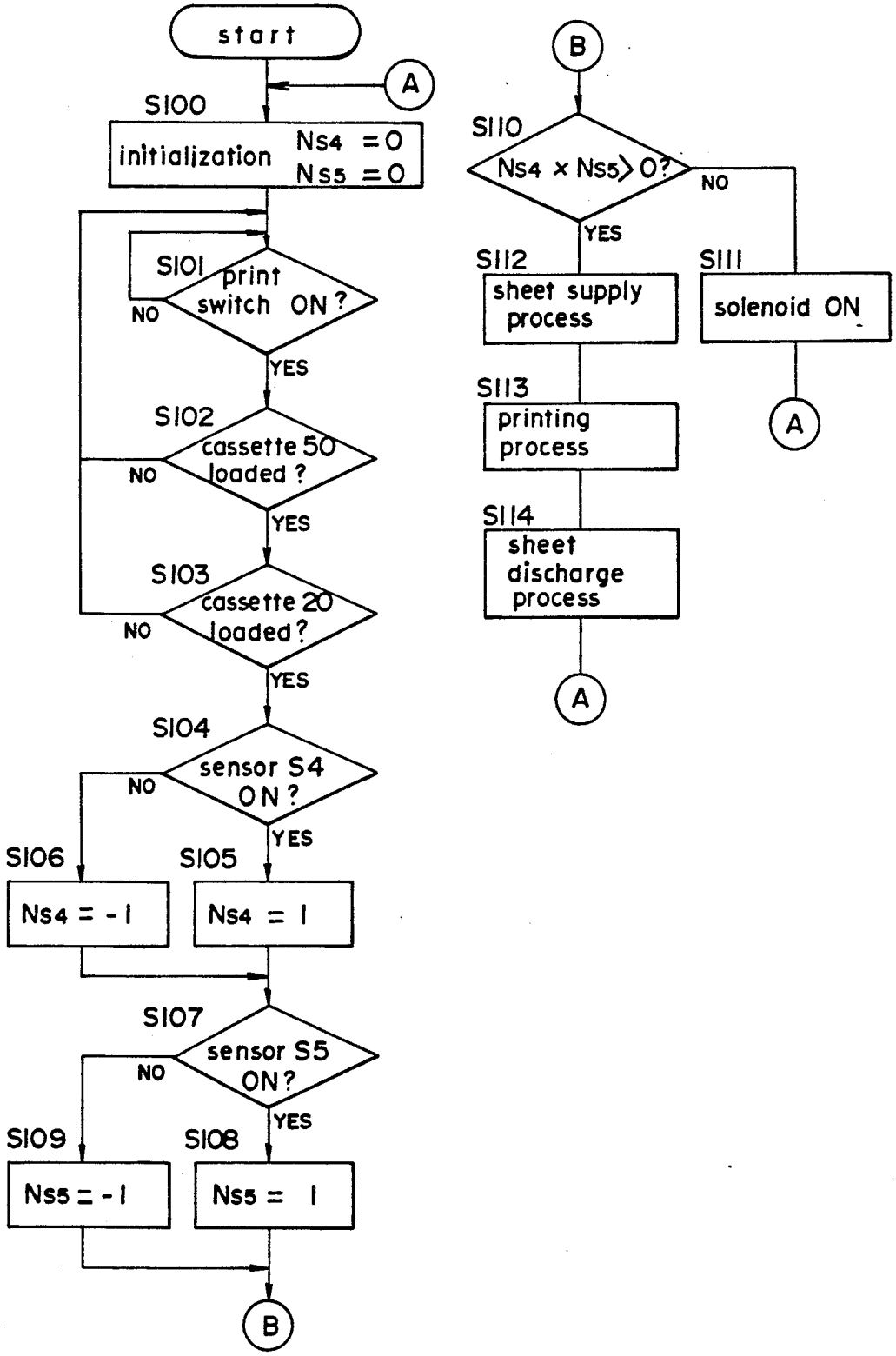
FIG. 7 is a flow chart showing the operating sequence of the second embodiment of the thermal transfer recording device of the invention.

The image forming sequence of the second embodiment of the thermal transfer recording device of the present invention is described hereinafter with reference to FIG. 7.

When the power unit of the thermal transfer recording device in the drawing is switched on, the CPU 56 and each component of the device is initialized in step 100. This initialization also initializes the variables $N_{S4}$ and $N_{S5}$, but otherwise the initialization is identical with that of step 80 of the first embodiment and is, therefore, omitted form this description. Furthermore, the steps subsequent to step 10, i.e., steps 101 through 109 are identical to steps 81 through 89 of the first embodiment and are, therefore, omitted form this description.

In step 108 or step 109, a predetermined value [1 or −1] is set for the variable $N_{S5}$, and in step 110 a check is made to determine whether or not the type of recording sheet P and the type of ink film 16 are compatible. This determination is also identical to that in step 90 of the first embodiment. If the product of the variables $N_{S4}$ and $N_{S5}$ is positive, the type of recording sheet P and the type of ink film 16 are compatible, whereas a negative product indicates the sheet P and in film 16 are incompatible.

When the type of recording sheet P and the type of ink film 16 are found compatible by the aforesaid determination, the process of reproducing the image on the sheet P is started in step 112. On the other hand, when the type of the sheet P and the type of the ink film 16 are incompatible, current is supplied to the solenoid 74 in step 111, and the process returns to the initialization state of step 100. When current is supplied to the solenoid 74, the locking mechanism 67 releases the linkage of the hook 70*a* of the arm 70 with the channel 71, and the sheet cassette 20 held within the casing 10 by the pressure of the compression spring 65 is somewhat ejected therefrom. This state is shown in FIG. 6B.

In step 112, the sheet supplying process is executed identically to that described in step 96 of the first embodiment The printing process is executed in step 113. In the second embodiment, printing is enabled only when the type of recording sheet P and the type of ink film 16 are compatible, so that a uniform energy is always applied to the thermal head 13. Therefore, as a constant energy is applied to the thermal head 13 a printing process is executed which is identical to that of step 98 of the first embodiment, and in step 114 a discharge process is executed which is identical to that of step 99 of the first embodiment, whereupon image formation on a single recording sheet P is completed.

In the second embodiment, when the type of recording sheet P and the type of ink film 16 are incompatible, the operator is alerted to the situation by the partial ejection of the cassette 20 from the casing 10. Therefore, the printing process cannot be executed, and a reduction in the printing quality due to the incompatibility of the recording sheet P and the ink film 16 can be prevented.

In both the first and second embodiments, the incompatible status can be determined after loading either the sheet cassette 20 or the ink film cassette 50. It is all the more desirable, therefore, that the operator can readily determine the unsuitability state before loading the sheet cassette 20 into the thermal transfer recording device. Although labels 48 and 54 are attached to both the cassettes 20 and 50, these labels are displayed on only one part of the cassettes 20 and 50 so that the operator may overlook them. Therefore, the cassettes 20 and 50 should be color coded. For example, the OHP sheet Pa cassettes 20*a* and 50*a* should be entirely red in color, while the synthetic sheet Pb cassettes 20*b* and 50*b* should be entirely white in color. Using this arrangement, the operator will be able to visually distinguish the types of recording sheet P and the types of ink film 16 so that the compatible and incompatible states can be readily determined at the earliest stage prior to loading the cassettes in the thermal transfer recording device. Further, when using sheet cassettes 20 having a unique shape corresponding to the type of recording sheet P accommodated therein, the aforesaid discrimination may be accomplished by detecting the shape of the cassette 20.

In either of the previously described embodiments, the type of recording sheet P and the type of ink film 16 are determined via the presence or absence of sheet marks 49 and film marks 55 attached to the cassettes 20 and 50, respectively. However, the aforesaid marks 49 and 55 may be bar coded when there is an abundance of types of sheets P, ink films 16 and other information so as to differentiate among such types. Although the indirect determination of an type of sheets P and ink films 16 by determining the type of cassette 20 and 50 has been described, the recording sheet P and the ink film 16 may be directly detected so as to determine the types thereof.

The method for determining the state of compatibility of the various types of recording sheets P and ink films 16 is not limited to determining the presence or absence of marks 49 and 55 based on signals output from optical sensors S4 and S5. For example, notches may be provided on a part of the cassettes 20 and 50 according to the type of recording sheet P and ink film 16 accommodated therein, and mechanical switches such as a limit switch or the like may be positioned in correspondence with the various notches so as to effect a determination based on signals output form the switches.

Furthermore, the method for warning of mismatched cassettes may be such that it mechanically prevents loading mismatched cassettes 20 and 50. For example, when an OHP sheet ink film cassette 50*a* is loaded first in the main unit, the loading of the synthetic sheet cassette 20*b* may be prevented by providing a protrusion or the like in the sheet cassette loading opening. The OHP sheet cassette 20*a* may be shaped so as to prevent insertion of the cassette by means of the aforesaid protrusion.

The type of recording sheet P may also be determined by the insertion direction of the cassette 20, even when the cassette is of a shape to accommodate a plurality of types of sheets in a single cassette.

In addition, the discrimination means for determining the type of sheet cassette and type ink film cassette may be constructed by providing a reed switch on the body of the thermal transfer recording device and a magnet on the cassette.

Although in the first embodiment the operator is alerted to incompatible types of recording sheets and ink films by a lighted warning lamp LED provided on the operation panel, it is to be noted that incompatible recording sheets and ink film may be indicated by a lighted warning lamp LED on an LED panel.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A thermal transfer recording device comprising:

a main body;

accommodating means for accommodating recording sheets and loadable into the main body;

first discriminating means for detecting whether the recording sheets accommodated in said accommodating means which is loaded into the main body of the device are a transparent type or a nontransparent type;

second discriminating means for detecting whether an ink film attached to the main body of the device is compatible with the sheets of the transparent type or the sheets of the nontransparent type;

alarm means for alerting a operator; and control means for controlling the alarm means so as to actuate the alarm means when the ink film attached to the main body of the device is incompatible with the recording sheets accommodated in the main body of the device.

2. A thermal transfer recording device as claimed in claim 1 wherein the alarm means alerts the operator by lightening a LED lamp provided at the device.

3. A thermal transfer recording device as claimed in claim 1 wherein the recording sheets are stored in a cassette and the ink film is arranged in a unit, both of the cassette and the unit being loadable into the main body of the device.

4. A thermal transfer recording device as claimed in claim 3 wherein each the first and second discriminating means includes a sensor which detects detectable means provided at the cassette or the unit for showing the type of the recording sheets or the ink film.

5. A thermal transfer recording device as claimed in claim 3 wherein the alarm means alerts the operator by protruding a part of the cassette outwardly from the main body.

6. A thermal transfer recording device comprising:

a main body;

a cassette loadable into the main body of the device for accommodating either transparent sheets or nontransparent sheets;

a unit loadable into the main body of the device for accommodating either a first ink film compatible with the transparent sheets or a second ink film compatible with the nontransparent sheets;

first detecting means for detecting whether a cassette loaded in the main body of the device accommodates the transparent sheets or the nontransparent sheets;

second detecting means for detecting whether a unit loaded in the main body of the device accommodates the first ink film or the second ink film;

display means for displaying any trouble in the device; and control means for controlling the display means so as to display the trouble when the unit is incompatible with the cassette.

7. A thermal transfer recording device as claimed in claim 6 further comprising:

image forming means for forming an image on the recording sheets;

input means for inputting an instruction of starting the device; and second control means for controlling the image forming means so as to operate when the instruction is input by the input means within a predetermined period from a display by the display means.

8. A thermal transfer recording device comprising:

a cassette loadable into a main body of the device for accommodating either first recording sheets or second recording sheets having different characteristics from the first recording sheets;

a unit loadable into the main body of the device for accommodating either a first ink film compatible with the first recording sheets or a second ink film compatible with the second recording sheets;

first detecting means for detecting a type of the cassette loaded in the main body of the device;

second detecting means for detecting a type of the unit loaded in the main body of the device;

image forming means for forming an image on the recording sheets;

inhibiting means for inhibiting the image forming means from operating; and control means for controlling the inhibiting means so as to inhibit the image forming means from operating when the type of the unit is incompatible with the type of the cassette.

9. A thermal transfer recording device as claimed in claim 8 further comprising:

supply means for supplying the recording sheets in the cassette to a portion for an image formation by the image forming means, and wherein the inhibiting means includes moving means for moving the cassette from a first position at which the supply means is capable of supplying the sheets in the cassette to a second position at which the supply means is incapable of supplying the sheets.

10. A method in a thermal transfer recording device comprising the steps of:

accommodating recording sheets into a main body of the device;

attaching an ink film into the main body of the device;

discriminating whether the recording sheets are a transparent type or a nontransparent type, and whether the ink film is compatible with the sheets of the transparent type or the sheets of the nontransparent type; and alerting an operator when the type of the ink film is incompatible with the type of the recording sheets.

11. A recording device for forming images from various colored products on various types of sheets, certain colored products being more compatible with certain types of sheets, comprising:

means for forming images;

first means for receiving sheets;

second means for receiving colored products;

first detecting means for detecting whether the sheets loaded in the first receiving means are transparent or nontransparent;

second detecting means for detecting whether the colored products loaded in the second receiving means are compatible with transparent sheets or nontransparent sheets;

means for storing information on results detected by said first and second detecting means;

means for warning an operator when inappropriate combinations of sheets and colored products are detected; and means for enabling a formation of images after a warning, including a control means responsible to the results detected by said first and second detecting means to process corresponding stored information to maximize a quality of formed images developed by the image forming means when inappropriate combinations of sheets and colored products are detected.

12. A recording device as claimed in claim 11 wherein the image forming means includes a thermal head and the control means provides a signal to change a contact pressure of the thermal head to compensate for inappropriate combinations of sheets and colored products.

13. A recording device as claimed in claim 11 wherein the image forming means includes an ink film cartridge and the control means provides a signal to change a winding tension of the film to compensate for inappropriate combinations of sheets and colored products.

14. A recording device as claimed in claim 12 further including means to prevent forming images for a predetermined time period in correlation with a activation of the warning means.

15. A thermal transfer recording device comprising:

a main body;

means for accommodating recording sheets, including a cassette that can be mounted in the main body;

a first discriminating means for detecting the type of recording sheets accommodated in the main body of the device;

second discriminating means for detecting the type of an ink film attached to the main body of the device;

alarm means for alerting a operator by causing a portion of the cassette to protrude outward from a mounted position in the main body; and control means for controlling the alarm means so as to actuate the alarm means when the type of ink film attached to the main body of the device is incompatible with the type of recording sheets in the cassette.

16. A recording device for forming images from various colored products on various types of sheets, certain colored products being more compatible with certain types of sheets, comprising:

means for forming images;

first means for receiving the colored products;

second means for receiving the sheets;

means for detecting a type of colored product loaded in the first receiving means;

means for detecting a type of sheet loaded in the second receiving means;

means for storing information on the types of colored product and types of sheet;

means for warning an operator when inappropriate combinations of sheets and colored products are detected;

means for enabling a formation of images after a warning, including a control means responsible to the type of sheet and the type of colored product detected to process corresponding stored information to maximize a quality of formed images developed by the image forming means when inappropriate combinations of sheets and colored products are detected; and means to prevent forming images for a predetermined time period in correlation with an activation of the warning means.

* * * * *